US008708146B2

(12) United States Patent
Falcon

(10) Patent No.: US 8,708,146 B2
(45) Date of Patent: Apr. 29, 2014

(54) TWIST RECLOSABLE BLISTER PACKAGE

(75) Inventor: Sara Jane Falcon, Richmond, VA (US)

(73) Assignee: MeadWestvaco Corporation, Richmond, VA (US)

( * ) Notice: Subject to any disclaimer, the term of this patent is extended or adjusted under 35 U.S.C. 154(b) by 124 days.

(21) Appl. No.: 13/300,015

(22) Filed: Nov. 18, 2011

(65) Prior Publication Data

US 2012/0125796 A1 May 24, 2012

Related U.S. Application Data

(60) Provisional application No. 61/446,194, filed on Feb. 24, 2011, provisional application No. 61/415,544, filed on Nov. 19, 2010.

(51) Int. Cl.
*B65D 73/00* (2006.01)

(52) U.S. Cl.
USPC ..... 206/467; 206/462

(58) Field of Classification Search
CPC ..... B65D 75/36; B65D 75/366
USPC ..... 206/464, 465, 461, 467, 468, 462
See application file for complete search history.

(56) References Cited

U.S. PATENT DOCUMENTS

| | | | | |
|---|---|---|---|---|
| 3,044,618 | A | 7/1962 | Surloff | |
| 3,178,019 | A * | 4/1965 | Fetzek | 206/465 |
| 4,705,163 | A * | 11/1987 | James | 426/128 |
| 5,613,607 | A * | 3/1997 | Kalmanides et al. | 206/467 |
| 6,889,840 | B2 | 5/2005 | Schein et al. | |
| 7,144,635 | B2 | 12/2006 | Hawes et al. | |
| 7,513,369 | B1 * | 4/2009 | Lee | 206/779 |
| 2004/0182735 | A1 * | 9/2004 | Lombardi et al. | 206/461 |
| 2010/0170821 | A1 * | 7/2010 | Grosskopf | 206/462 |
| 2013/0228488 | A1 * | 9/2013 | Wu et al. | 206/462 |

FOREIGN PATENT DOCUMENTS

| | | | |
|---|---|---|---|
| DE | 20120503 | U1 | 4/2003 |
| FR | 1333755 | A | 8/1963 |
| WO | WO2008154566 | A1 | 12/2008 |

OTHER PUBLICATIONS

PCT/US2011/057281 International Search Report, mailed Oct. 21, 2011.

* cited by examiner

*Primary Examiner* — David Fidei
(74) *Attorney, Agent, or Firm* — MWV Intellectual Property Group

(57) ABSTRACT

A package is disclosed comprising a blister with a flange enclosed between paperboard cards, arranged so that upon rotation of the blister the flange emerges from between the cards allowing the blister to be separated from the cards.

17 Claims, 12 Drawing Sheets

TWIST RECLOSABLE BLISTER PACKAGE

REFERENCE TO RELATED APPLICATIONS

This application claims the benefit of priority under 35 U.S.C. §119(e) of U.S. provisional applications Ser. No. 61/415,544 filed on Nov. 19, 2010, and 61/446,194 filed on Feb. 24, 2011, which are hereby incorporated by reference in their respective entireties.

BACKGROUND

The present application is directed to paperboard packages and, more particularly, reclosable security packages with a twist-open feature.

Manufacturers and retailers of consumer goods, such as pharmaceuticals, software, electronics, health and beauty products and the like, typically package their products in tamper resistant security packages. For example, many consumer goods are packaged in blister or clamshell packages formed by positioning a consumer good in a flanged blister made from various polymeric and/or paperboard materials and sealing the flanged blister between two paperboard substrates. Consumers have voiced disapproval of such packages because of the difficulty of opening the same and the potential for being cut on a rough edge especially of plastic blisters. Packages may therefore be made based largely on paperboard, for example, NATRALOCK® packages. Packaging made primarily of paperboard is more sustainable than packaging made from petroleum-based plastics. The paperboard used in such packages may be tear-resistant as described in commonly assigned U.S. Pat. No. 7,144,635.

Some blister packages may comprise a paperboard card and a blister. Especially when made with tear resistant paperboard, these packages can be quite secure and may require a tool such as a scissors or knife to open the package. Thus the secure structure of the packages may prevent in-store theft and tampering. However, after purchase, when the package has been cut to remove the product, the user may wish to still use the package around the house for occasionally storing the product. Such might be the case if the product is a small tool that is used occasionally, but is otherwise most conveniently kept in the package, for example due to safety reasons such as with replacement blades for a utility knife, or due to product protection for example with small flashlight bulbs that are easily lost or broken, or for orderly product storage, for example with many hardware items such as bolts, screws, etc which become lost or commingled if not kept in a package. If a security package has been cut open, it often becomes unusable or difficult to use for future storage of the product. Furthermore, even an unwanted product is returned to the retailer, the package may be damaged enough so that the retailer cannot sell it again (e.g. as discounted returned goods). It would be advantageous therefore to have a security package which, after opening, could still be returned to a closed configuration for containing its contents. Even with a less-secure or non-secure package or non-secure package, it may be desired to have a structure that permits the package to be returned to a closed configuration after accessing its contents.

The current application discloses a blister package that may be opened by rotating the blister, and after being opened, may be reclosed also by rotating the blister.

SUMMARY

In one aspect a package is disclosed which comprises a first card and a second card comprised of sheet material and partly sealed together, and a blister having a peripheral flange that is trapped between the cards. The blister may be detached from the package by twisting the blister in a rotating motion to free the flange from between the cards. After the package is opened, it may be reclosed by again rotating the blister to position the flange again between the cards.

Other aspects of the disclosed packaging structures will become apparent from the following description and the accompanying drawings.

A reclosable feature is provided on a blister pack. The reclosable feature allows consumers the ability to handle a product before purchase (i.e. to check sizing, texture, etc.), and to also use the package for storage of the product after purchase. In another embodiment for retail security packaging, a one time secure opening feature is provided which after opening acts as an indicator of an opened package, but the package is still reclosable. This initial one time security feature would meet the requirements of retail loss prevention groups for initial security packaging requirements. Having a reclosable feature allows the product to be repackaged for store returns, making the package and product able to be redisplayed as saleable merchandise.

A one piece case such as a thermoform blister may be used, which may fit between two cards or between the halves of a one-piece hinged card. However, case or "blister" as used herein is meant to also encompass container structures made by injection molding, stamping, pressing, and other methods. The blister peripheral portion may include a flange that may be trapped between two cards although most or all of the flange may lack any sealing to either card. The flange may be designed as a single pitch of "thread" that may be "unscrewed" from between the two cards, or "screwed" back between the two cards, by way of a notch in one of the cards.

Using tear resistant board such as MeadWestvaco NATRALOCK® combined with rotational blister closure referenced above may provide a retail security package with some degree of difficulty to open, which still after opening retains a neat appearance and is easy reclosed.

DETAILED DESCRIPTION

Figure 1:
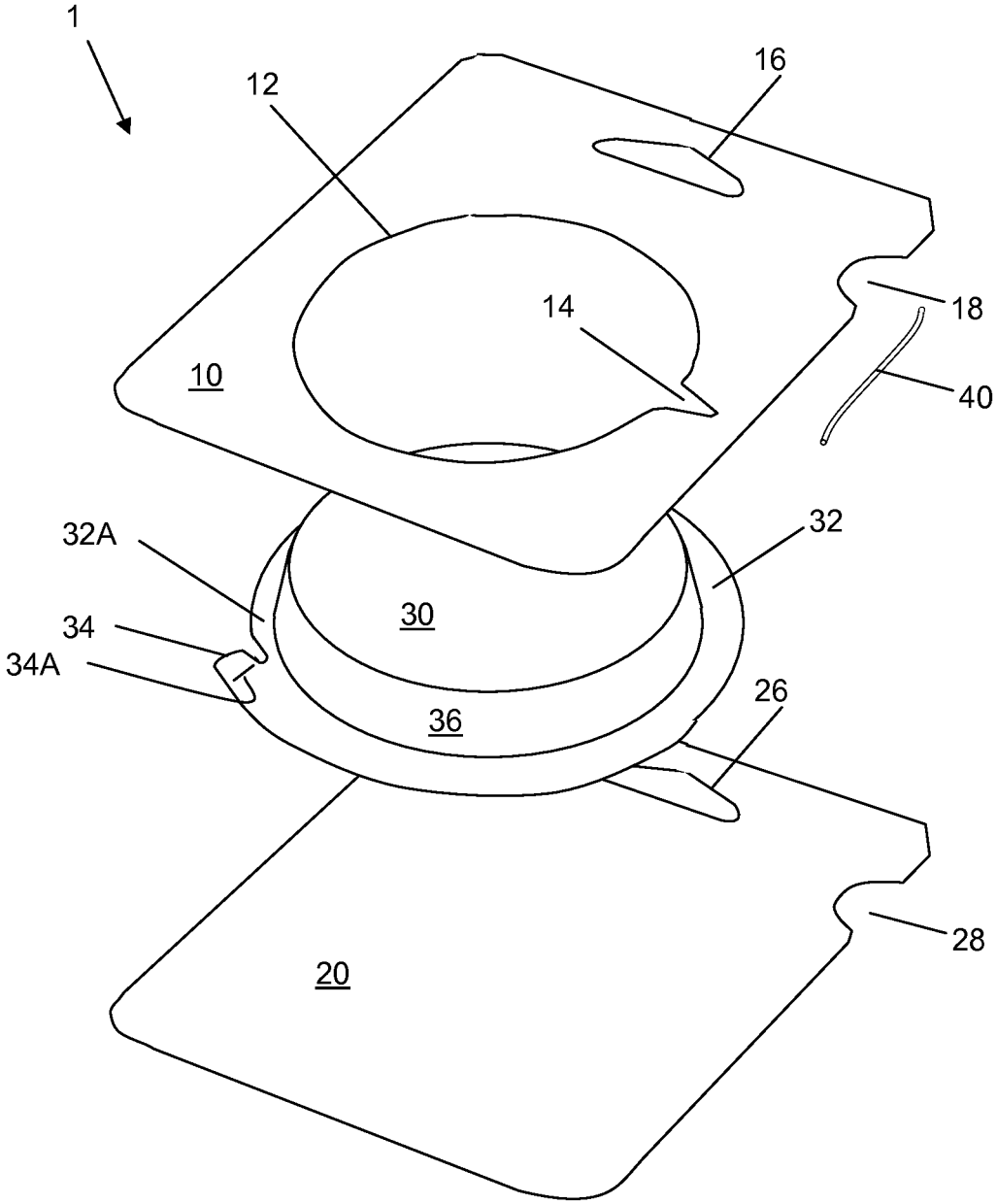
FIG. 1 is a perspective, exploded view of parts for forming a package.

As various embodiments of the security package are described, reference will be made to FIGS. 1-10. Certain parts of the packages are denoted by reference numerals. Where there is more than one of the same feature, sometimes only one will be denoted by a reference numeral. If different packages have a common feature, it may only be described one time. Typically in these Figures, solid lines show edges, while dashed lines show hidden or partially obscured features.

Where assembly steps are described, these steps are exemplary and are not to be limiting as to the sequence of operations used to arrive at the final package. Also, directions such as up, down, top, bottom, front, back, etc. are used for convenience in describing the package and are not meant to be limiting. In most cases the packages described here are made from one or several blanks (that is, the cut sheet parts from which the package components are made by folding and other steps). However, it should be understood that certain unitary blanks may be provided instead as more than one part, and certain blanks may be combined into single blanks, while still arriving at the same finished package.

FIG. 1 shows a top perspective view of the parts of a package 1, including a front card 10 and rear card 20 for forming the package. An aperture 12 may be provided in the front card, to receive a case or blister 30 as described below. The aperture may be circular. Aperture 12 may include an exit notch 14. Hang holes 16, 26 may be provided on one or both cards. Card peripheral notches 18, 28 may be provided which may be useful for holding a sample 40 of the package contents. For example if the contents of the package are a thread, wire, ribbon, or other spooled material, the customer may wish to handle a sample. A sample could be sandwiched between the front card 10 and rear card 20 at the notches 18, 28 so that the customer could handle the material without opening the package. Such notches may also make it easier to hold or handle the package during the process of opening and reclosing the package as described below.

Although front card 10 and rear card 20 may be provided separately as shown, they may also be provided as a single piece, for example, with the front card 10 and rear card 20 joined along a hinge or fold line. The cards may be made of a sheet material such as paperboard, or of a tear-resistant paperboard such as MeadWestvaco NATRALOCK®. The cards may be similar in size and shape, for example both being rectangular as shown in FIG. 1. The overall shape of the cards may be rectangular as shown, or any desired shape. The front and rear cards may differ in size and shape, for example, the upper region of either card may be shorter than the upper region of the other card. This might be done for example to save material. If a hang hole is desired, a single ply hang hole may be sufficient and may be provided either as hang hole 16 in front card 10 (if the upper region of rear card 20 is shortened), or hang hole 26 in rear card 20 (if the upper region of front card 10 is shortened).

Aperture 12 in front card 10 may receive a case or blister 30. For example, the blister may have a circular cylindrical shape including a side wall 36. The blister may have a flange 32 that may be sandwiched between front card 10 and rear card 20. The flange 32 may have a flange tab 34 whose purpose will be described. The flange 32 may be a planar flange and the flange tab 34 may be bent upward slightly relative to the rest of the flange, for example along a crease line 34A. The blister may have a different shape than shown in FIG. 1. However it may be advantageous for the blister 30, or at least for the flange 32, to have an approximately circular shape to allow the blister and flange to move as described below. Approximately circular shapes, by way of example, could include polygons with five or more sides, Alternatively the blister may have a non-circular shape while the flange has a generally circular shape.

Case or blister 30 may be made with common thermoform plastics such as PVC or APET but may also include a recycled material such as RPET or a biodegradable material such as PLA. However other materials including other plastics or paperboard may also be used. Besides thermoforming, the case or blister may be formed by injection molding or other manufacturing methods.

Figure 2:
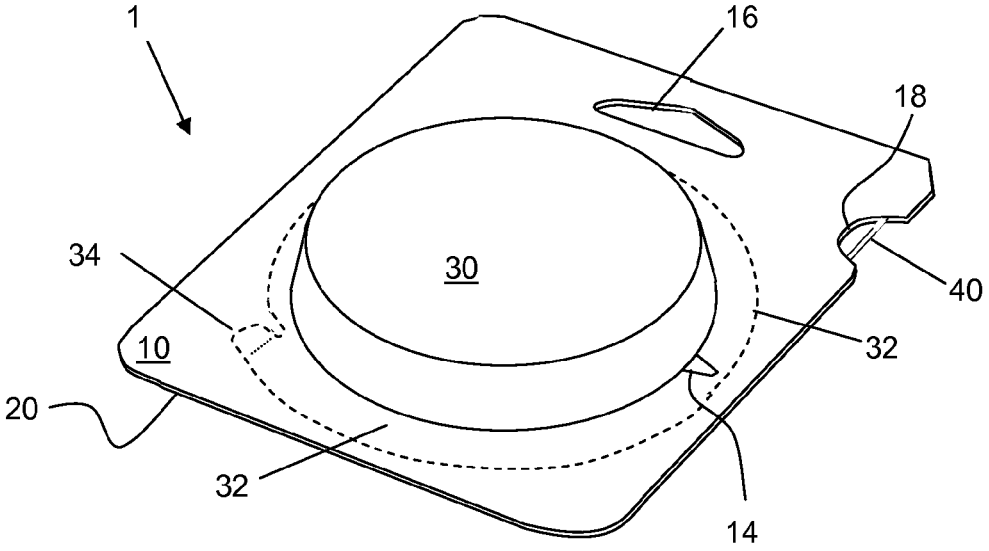
FIG. 2 is a perspective view of the finished package of FIG. 1.

Blister 30 may be sandwiched between front card 10 and rear card 20 to form a securely closed package as seen in FIG. 2, where the now hidden flange 32 is shown in dashed line. The cards may be joined together by heat sealing, RF (radio frequency) sealing, ultrasonic sealing, adhesive, or other means. Such sealing may be done on most of the facing surfaces of the front and rear cards (except the vicinity of flange 32 as further described) or sealing may be done to less than the entire facing surfaces, for example only around the outer perimeter of the card, and along and outer perimeter of flange 32 (but not necessarily sealing the flange itself).

Figure 3A:
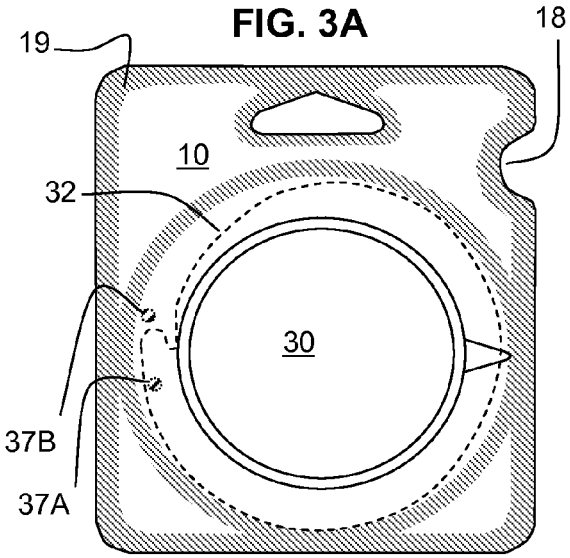
FIGS. 3A-3D show plan views of the package at several stages between a closed and open configuration.

FIGS. 3A-3D show plan views of a series of stages in removing blister 30 from the package. As shown in FIG. 3A, in a closed configuration the blister 30 is held in the package by flange 32 being sandwiched between front card 10 and rear card 20 (not shown). Thus flange 32 may be securely sandwiched between the front card 10 and rear card 20 without being sealed to the cards. The inside surfaces of the front and rear cards may be sealed together in certain regions such as sealed region or regions 19, for example around the card periphery, and just outside the flange 32. Most or all of flange 32, however, may be free from any attachment to the front and/or rear cards. Even without any attachment between the flange 32 and the cards 10, 20, the close fit therebetween may closely hold the flange 32 and restrain movement. Optionally, However, one or more tack points may be provided such as tack point 37A where flange 32 is attached temporarily to one or both cards, or block point 37B where the two cards are sealed together temporarily to block movement of flange 32. If such tack or block points are provided, they may be designed to break loose upon moderate force to allow the package to be thereafter open and closed as described next.

Figure 3B:
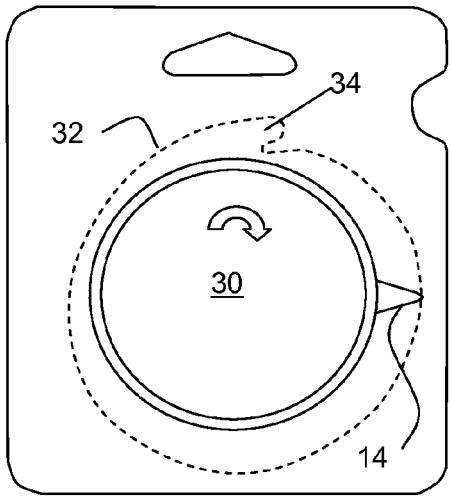

Although flange 32 is sandwiched between the cards, it may not strongly attached to either, so that blister 30 may be grasped and rotated so that the flange 32 slides between the two cards. FIG. 3B illustrates the blister 30 having been rotated clockwise about 90 degrees, as indicated by the flange tab 34 having moved from about the nine o'clock position to the twelve o'clock position.

Figure 3C:
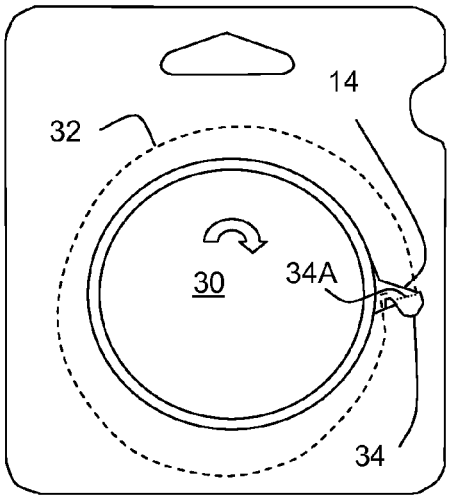

FIG. 3C shows the blister rotated still further clockwise to about the three o'clock position, at which point the flange tab 34 encounters exit notch 14 in the front card. Flange tab 34 may at this point begin to travel above the front card. A lifting feature may be provided in the flange, flange tab, rear card, front card, or between the cards. For example, a lifting feature may be provided as a slight crease or fold line 34A scored into flange tab 34 to cause it to flex upward when it encounters exit notch 14.

Figure 3D:
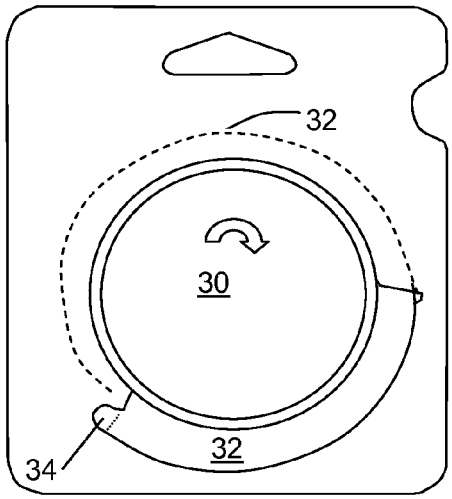

FIG. 3D shows the blister rotated still further clockwise to about the six o'clock position, where a significant portion of the blister flange 32 is now above front card 10. Continued rotation of blister 30 eventually "unthreads" or "unscrews" the blister flange 32 from between the cards, thus allowing the blister to be lifted away from the cards, and the contents to be exposed. However, by placing the blister on top of the front card, and rotating in the opposite (here, counterclockwise direction) the flange 32 may be caused to re-enter exit notch 14 (for example starting with point 32A as seen in FIG. 1) and again be "threaded" counterclockwise into the space between the cards to closed the package. Alternately, flange tab 34 may be depressed to direct it into the exit notch 14, and the blister 30 then "threaded" clockwise into the package.

Instead of rotating blister clockwise to open the package, and counterclockwise to close the package, the package may be designed so that a counterclockwise rotation is used to open the package, and a clockwise rotation to close the package.

If as shown in FIG. 3A-3D, the blister flange 32 is provided with one flange tab 34, and the front card is provided with one notch 14, the package may be set up to require as much as two blister rotations to open the package. This could occur, for example, if the flange tab 34 was initially positioned at the four o'clock position, so that nearly a full clockwise turn would occur before the flange tab encountered the notch, followed by as much as another rotation for the flange to completely clear the notch. However, with the flange tab initially located at the four o'clock location, the package might also be opened by first rotating the blister counterclockwise about 45 degrees until the flange tab cleared the notch, then rotating the blister clockwise to "unthread" the flange.

Exit notch 14 may be positioned at locations around the periphery of the aperture other than the three o'clock position, for example at 12 o'clock. Locating the exit notch at locations further from an edge may result in a stronger construction.

To provide a package that opens with less rotation of the blister, multiple exit notches 14 may be provided around the aperture 12, or multiple flange tabs 34 may be provided on the flange 32. With two equally spaced exit notches 14 and two equally spaced flange tabs 34, the package may be designed so the first flange tab comes out an exit notch after not more than half a rotation, and so that blister is released completely in no more than an additional half rotation. The number of exit notches 14 and flange tabs 34 need not be equal. The exit notches 14 and/or flange tabs 34 may or may not be equally spaced.

After opening, the package may be reclosed to a configuration suitable for again storing the contents (or other items) in the closed package. If a purchaser returns the package to the retailer, the retailer may be able to place the package back into inventory (for example as discounted "returned/opened goods") since the reclosed structure still has a neat appearance and the package structure is still quite sturdy.

Figure 4A:
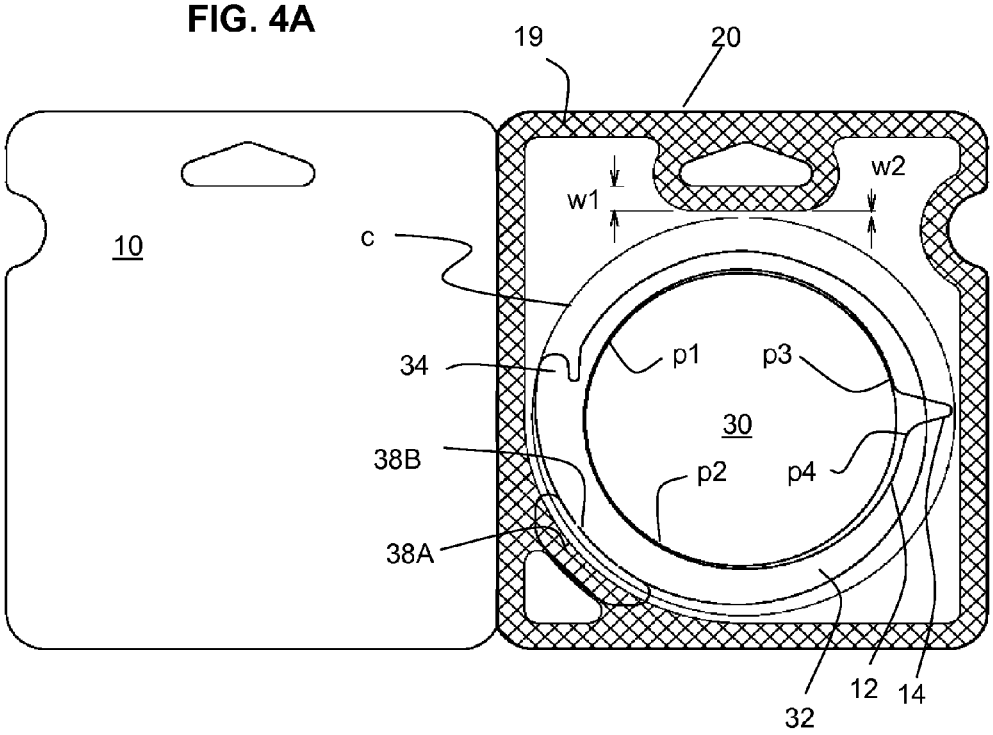
FIGS. 4A-4E show plan views of example packages having an initially secured closed configuration.

FIG. 4A shows an example package where front card 10 and rear card 20 are hingedly connected together as a single piece of material; however the cards may also be provided as separate pieces. An example adhesive pattern 19 is shown that may be used to adhere the front and rear cards together. The adhesive pattern may provide a width w1 of adhesive around edges including the peripheral edges of the cards, and the hang hole. It may be desirable to maintain a gap w2 between the adhesive pattern and the circumference C bounding the area through which the flange 32 and flange tab 34 will travel when rotated. A stop tab 38A may be provided, for example attached to the flange 34 by a line 38B that may be a score line or perforation line designed to break when a certain twisting force is applied to blister 30. The stop tab 38A may be at least partly adhered by adhesive pattern 19 to at least one of the front and rear cards as shown, or the adhesive pattern 19 may be at least placed around stop tab 38 sufficiently to prevent its movement. The stop tab may limit movement of the blister, and help serve as an indicator whether or not the package has been opened.

The aperture 12 may be sized to closely receive the blister 30. For example, as shown in FIG. 4A, the aperture 12 may be close to or contact blister 30 at sufficient points to limit translation movement while allowing rotational movement. Again, for example, providing close contact points p1, p2, and p3 between aperture 12 and blister 30 may hold the blister in position while allowing rotation (after any stop tab 38A is released). However, at point p4 a gap may be provided between aperture 12 and blister 30, in order to allow flange tab 34 to more readily exit from exit notch 14.

Figure 4B:
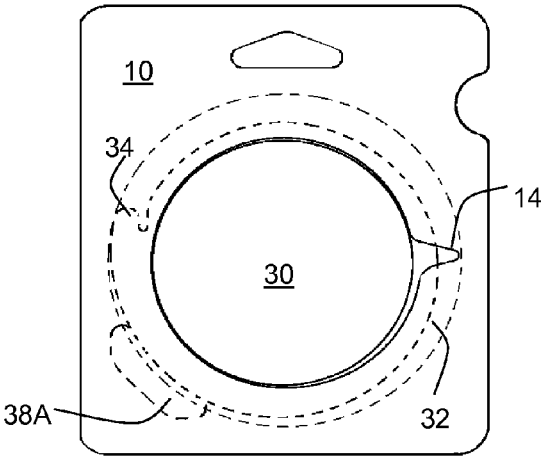

FIG. 4B shows the finished package of 4A, with the cards folded together. The flange 32, flange tab 34, and stop tab 38A are largely hidden between the cards.

Figure 4C:
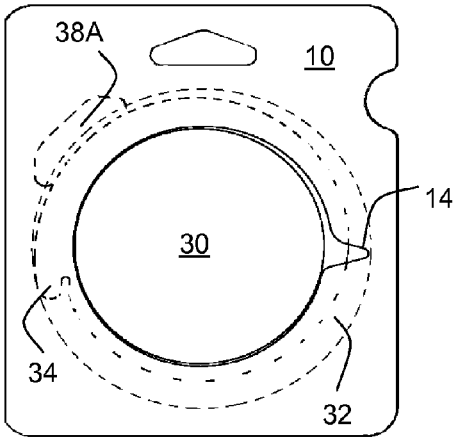

FIG. 4C shows an alternate design, where the package is adapted to be opened by turning the blister counterclockwise, for example by reversing the direction of flange tab 34, and adjusting the shape or direction of exit notch 14.

Figure 4D:
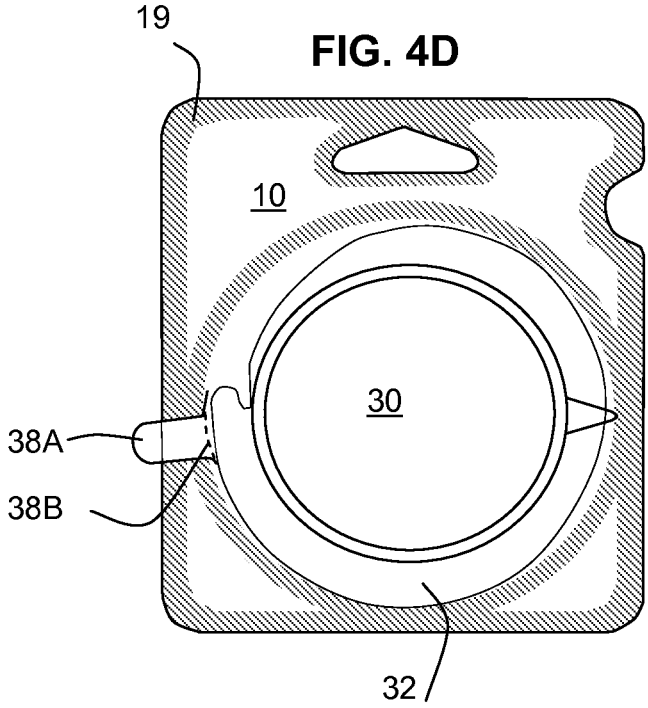
Figure 4E:
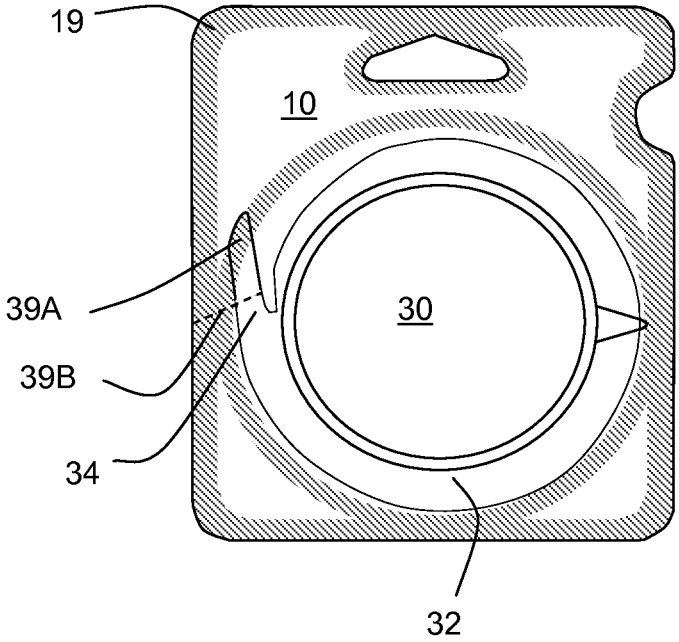

FIGS. 4D and 4E show other example packages with a security feature that makes it more difficult to open the package, and more evident if the package has been opened. Although flange 32 is hidden behind the front card 10, in FIGS. 4D and 4E the flange is drawn with a solid line for clarity. As shown in FIG. 4D, flange 32 may include a stop tab 38A to prevent turning the blister and removing it from the package. The stop tab 38A may extend somewhat radially from flange 32 and be joined to the flange along a perforation line 38B so that by applying sufficient force to the stop tab 38A, the perforation will break and allow the blister to rotate. The stop tab 38A may be free from any adhesive attachment to the front and rear cards, or it may be somewhat adhered thereto yet movable upon sufficient force in order to break perforation 38B. The stop tab 38A may be located near flange tab 34, as shown, or may be elsewhere on the flange. The stop tab may be located adjacent an edge of the package, or elsewhere in the package. If the stop tab is missing, this gives an indication that the package has been opened.

FIG. 4E shows an alternative stop tab 39A which extends somewhat tangentially to flange 32. The end of stop tab 39A may be held to the front or rear cards by adhesive, heat seal, or other means. A perforation line 39B may be provided through stop tab 39A and optionally through the adjoining front and or rear cards. To rotate the blister and open the package, the perforation 39B must first be torn to break stop tab 39A from flange 32, to allow rotation of the flange. If the perforation has been torn, this gives an indication that the package has been opened. The stop tab 39A may extend from flange tab 34, or it may be located elsewhere on the flange.

Figure 5A:
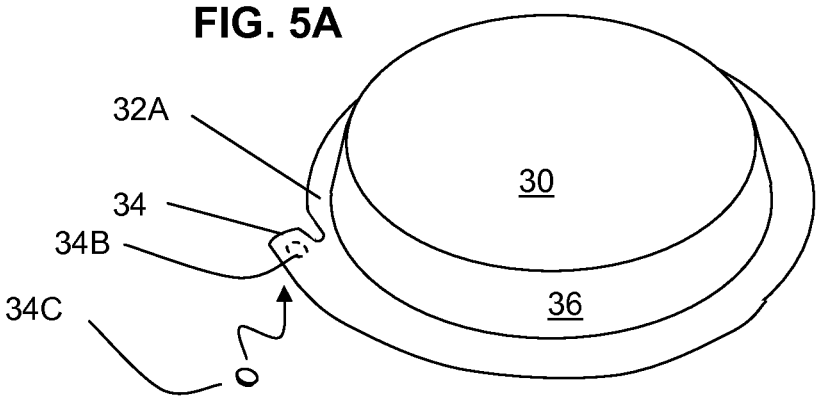
FIGS. 5A-5B show perspective view of alternative flange designs.

Instead of providing a crease line 34A on flange tab 34, other lifting features may be utilized to cause or allow the flange 32 to 'unthread' out of the package. FIG. 5A shows an alternative design where instead of crease line 34A, the flange tab 34 may be provided with a lifting feature 34B such as a downward embossment that will tend to lift the flange tab 34 and urge it through exit notch 14 once the exit notch is reached by the flange tab. Instead of embossing the flange tab, it may be otherwise formed so that when rotated, its leading edge upon reaching the exit notch 14 will tend to emerge from exit notch 14. Instead of or in addition to such embossing or otherwise forming the flange tab, a lifting piece 34C may be attached under flange tab 34 to lift the flange tab and urge it through exit notch 14. Such a lifting piece may, for example, have flat upper surface for attaching to the underside of flange tab 34, with a rounded or smooth lower surface for easily sliding on rear card 20 when the blister is rotated.

Figure 5B:
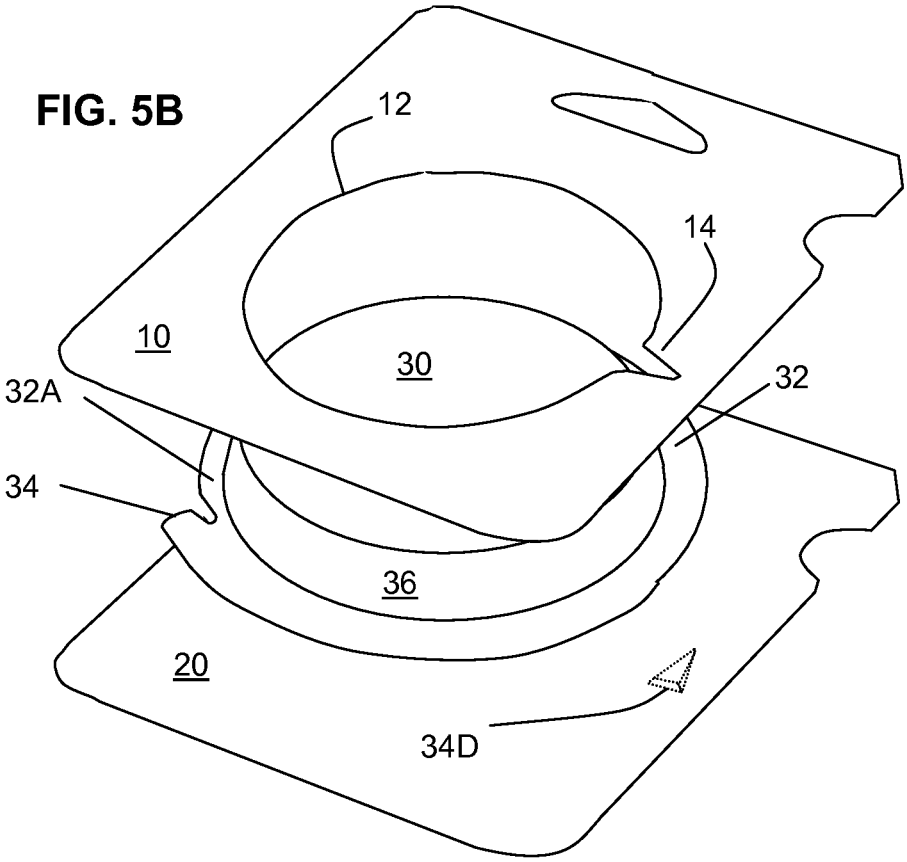

FIG. 5B shows another alternative means of lifting the flange tab 34. Rear card 20 may include a feature that in the finished package is proximate to exit notch 14. The feature may urge flange tab 34 upward through exit notch 14. The feature may, for example, be a lifting feature 34D such as a embossment, layer, or attachment in the form of a ramp, bump, or other shape to urge flange tab 34 through exit notch 14. Such a feature might be formed in rear card 20 or attached to the rear card immediately below exit notch 14 in front card 10. In this embodiment the flange tab 34 may not require any crease or lifting feature of its own. Furthermore, various lifting features may be provided on the flange, flange tab, rear card, front card, or between the cards and may be used either separately or in combination. The lifting features may direct or urge the flange tab 34 and/or flange 32 'upward' through the exit notch 14.

Figure 6A:
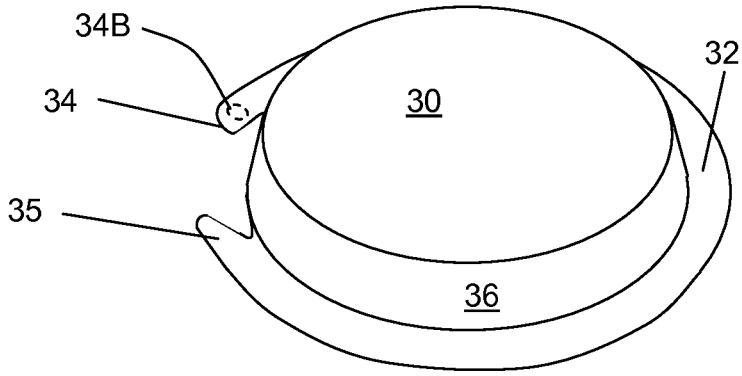
FIGS. 6A-6B show perspective views of another flange design.

FIG. 6A shows an alternative design where flange tab 34 is provided this time directed in a counterclockwise direction, which may provide a more intuitive operation since most 'threaded' utensils tend to operate 'counterclockwise to open, clockwise to close.' Flange tab 34 may be provided with a lifting feature 34B such previously disclosed that will tend to lift the flange tab 34 and urge it through exit notch 14 once the exit notch is reached by the flange tab. Instead of embossing the flange tab, it may be otherwise formed so that when rotated, its leading edge upon reaching the exit notch 14 will tend to emerge from exit notch 14. In addition to flange tab 34, which in this instance might be considered an 'exit' flange tab, a second flange tab 35 may be provided that may be used to 'thread' the flange back into the package through exit notch 34, in order to close the package. Thus second flange tab 35 might be considered an 'entrant' flange tab. In this instance the second flange tab 35 faces in a clockwise direction, so that 'threading' second or entrant flange tab 35 into notch 14 would be done in the clockwise movement familiar to a user. The shapes of the exit flange tab 34 and second or entrant flange tab 35 may be chosen by manufacturing preference. For example, entrant flange tab 35 may have a somewhat pointed end to help start it into the exit notch 14 when reclosing the package.

Figure 6B:
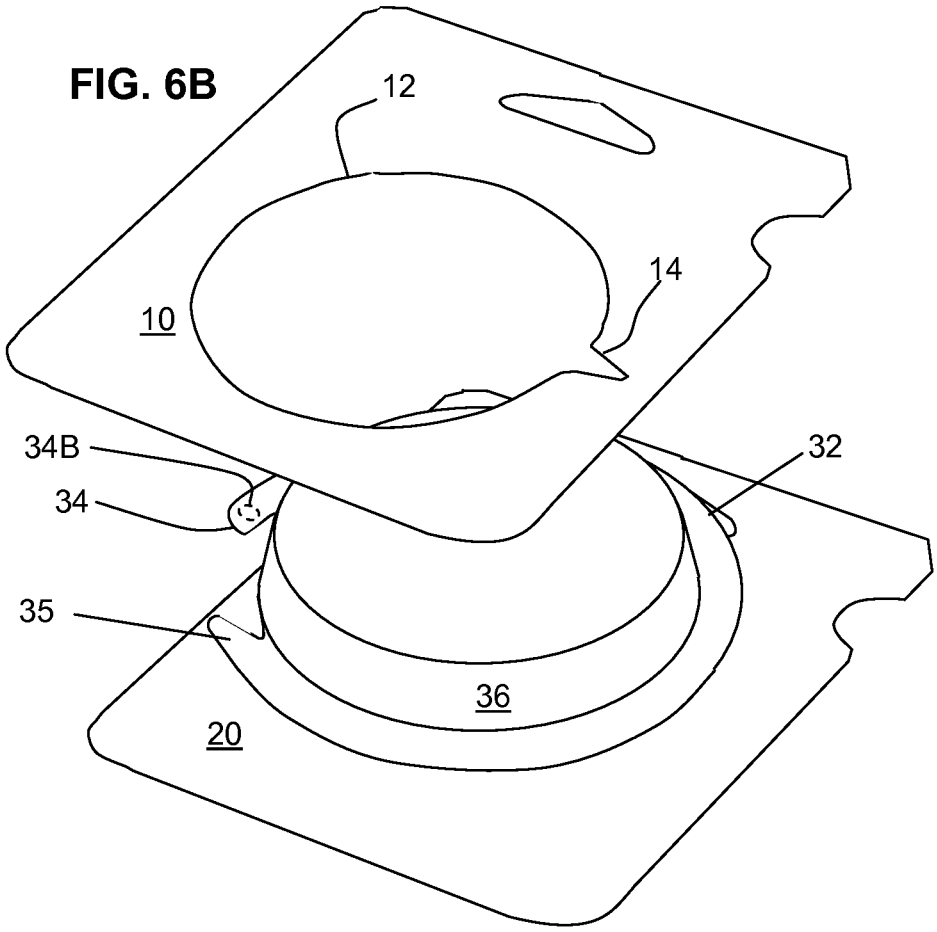

FIG. 6B shows the case or blister of FIG. 6A, in an exploded view of a package including front card 10 and rear card 20.

Figure 7A:
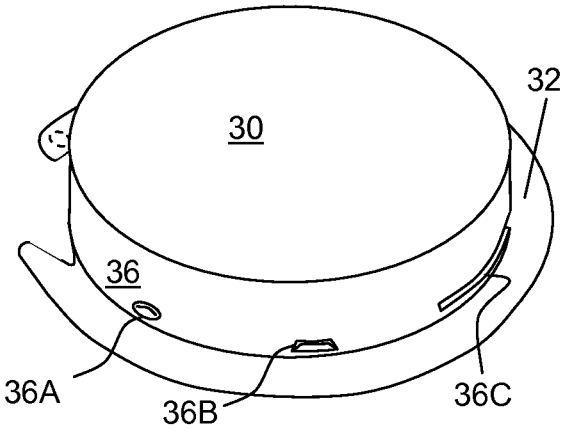
FIGS. 7A-7C show perspective views of various optional features of a case or blister portion of a package.

FIG. 7A shows another case or blister 30 whose side wall 36 includes content-retaining features 36A, 36B, 36C such as bumps, protrusions, ridges, grooves, or other shapes which may serve to hold contents inside the blister. One or more retaining features may be useful for retaining the contents while the blister is being rotated into or out of the package. The retaining feature may have any shape suitable for engaging at least a part of the contents to retain them in the blister. The retaining feature may be localized to one or more points around the side wall 36, or elsewhere on the blister. Alternately the retaining feature may extend a distance, or even entirely, around side wall 36 (for example as a circumferential groove or ridge. Depending on the shape of the contents, the content retaining feature or features may protrude inward, outward, or both.

Figure 7B:
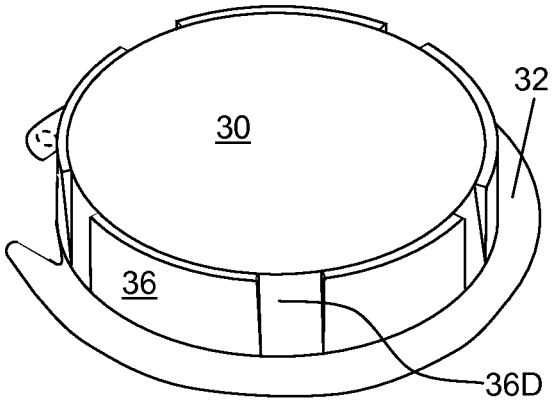
Figure 7C:
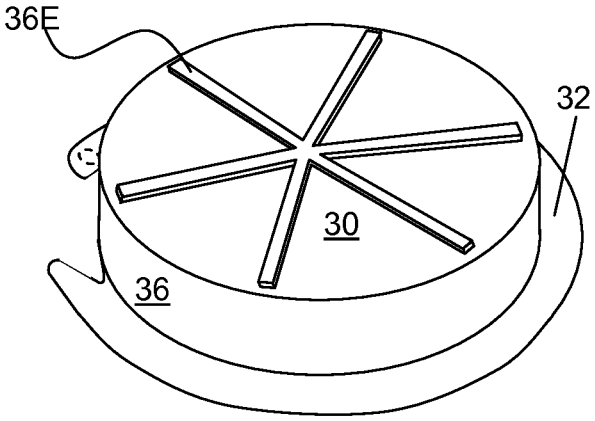

FIG. 7B shows another case or blister 30 whose side wall 36 includes grasping features 36D such as bumps, protrusions, ridges, grooves, serrations, columns, surface roughness, or other shapes by which a user may more readily grasp and rotate the blister. The grasping feature or features may have any shape suitable for a user to more readily hold and turn the blister. The grasping feature may be localized to one or more points around the side wall 36, or elsewhere on the blister. Alternately the grasping feature may extend a distance, or even entirely, around side wall 36 (for example as a periodic column or indentation, or as a continuous surface roughness). The grasping feature or features may protrude inward, outward, or both. FIG. 7C shows another case or blister 30 with a grasping features 36E located on its upper surface.

Figure 8:
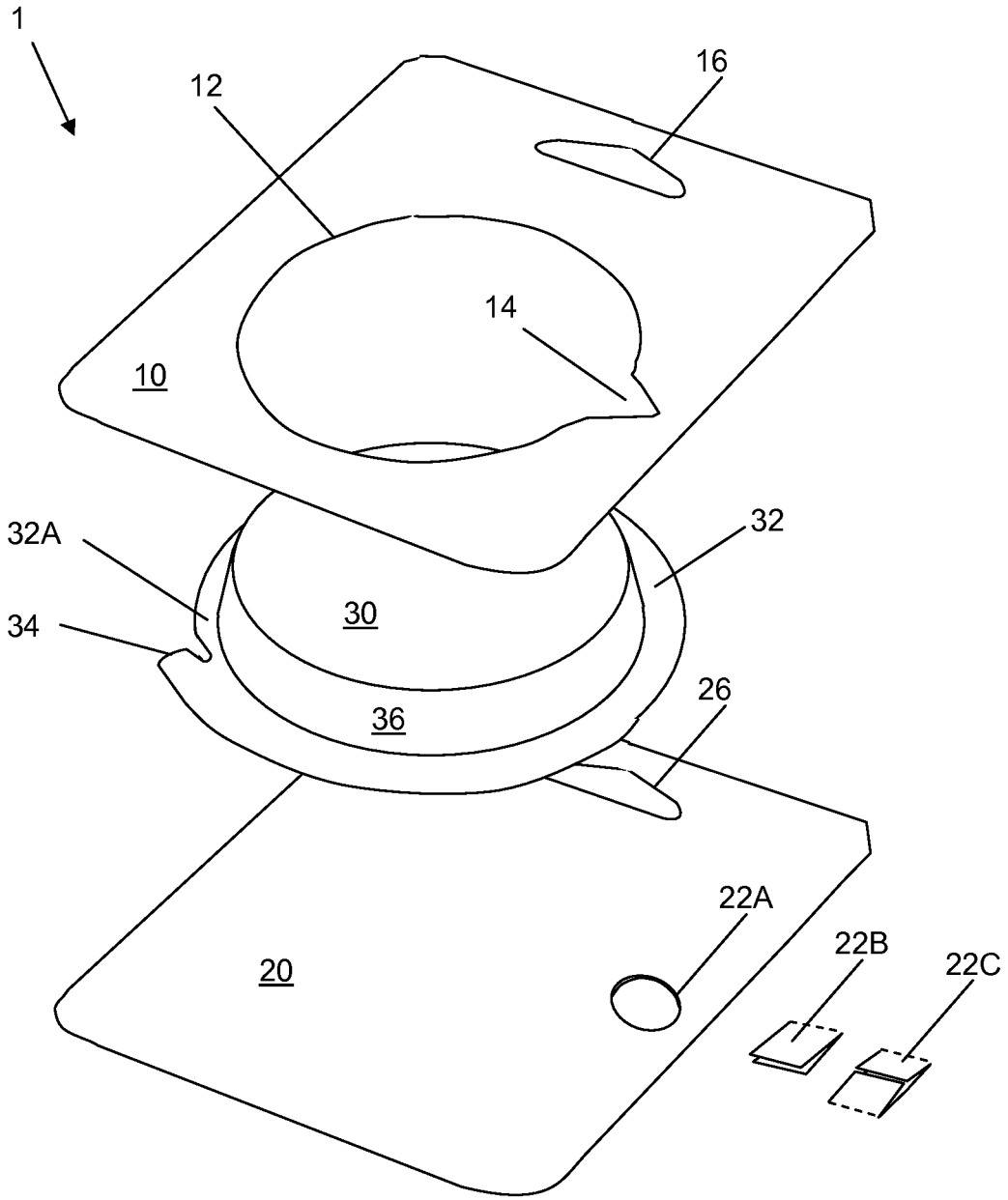
FIG. 8 is a perspective, exploded view of parts for forming another package.
Figure 9:
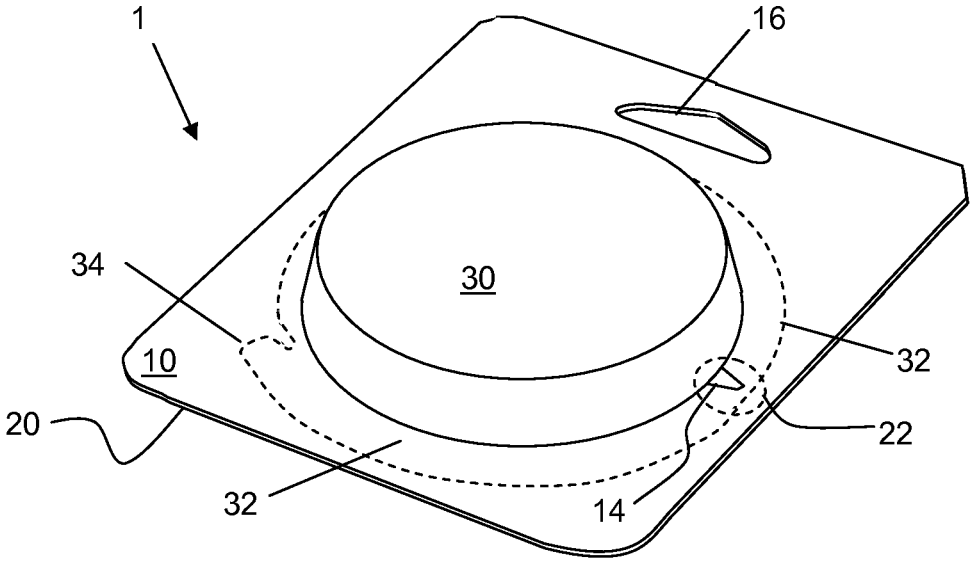
FIG. 9 is a perspective view of the finished package of FIG. 8.
Figure 10A:
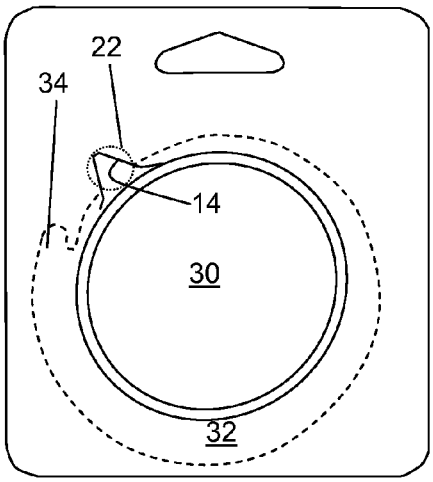
FIGS. 10A-10C show plan views of the package at several stages between a closed and open configuration.
Figure 10C:
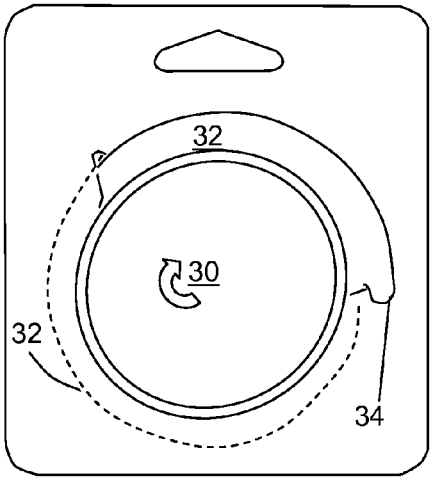
Figure 10B:
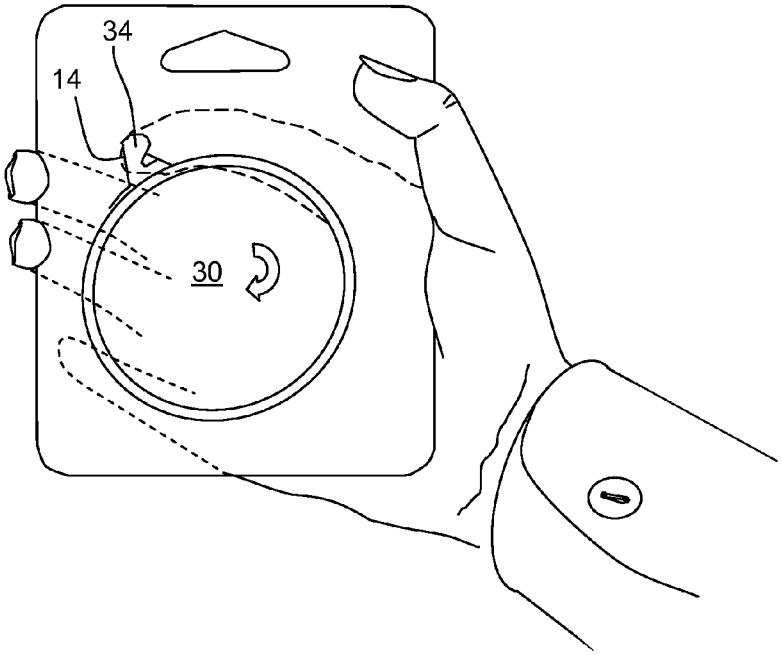
Figure 10D:
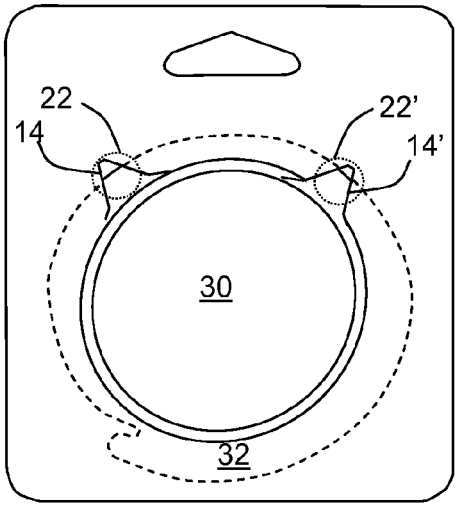
FIGS. 10D-10F show plan views of parts of alternative packages.
Figure 10E:
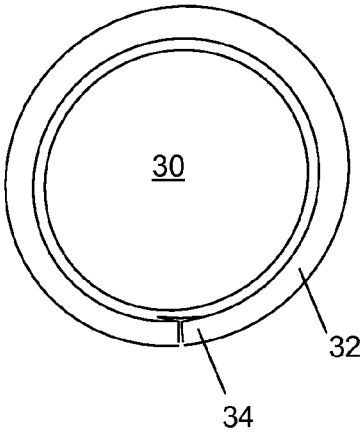
Figure 10F:
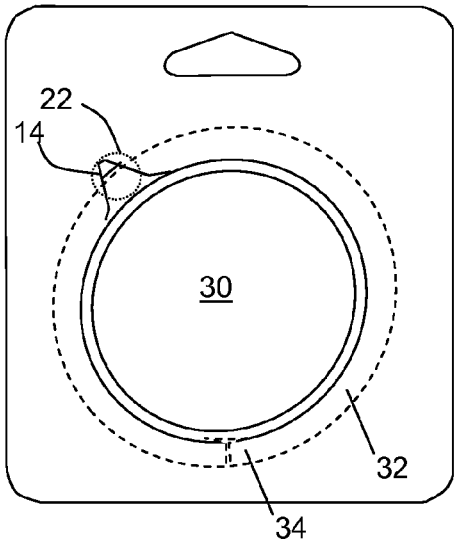

FIG. 8 shows another example package that has an opening 22 provided in rear card 20. This may be a hole 22A, or a cut unidirectional flap 22B, or bidirectional flap 22C, or other opening, which is behind the exit notch 14 in front card 10 as more clearly seen in FIG. 9. The notch and hole may be located anywhere around the blister. In FIG. 10A, the location of the exit notch 14 and opening 22 are at another position, that is, about 11 o'clock on the blister. FIG. 10B shows how a customer holding the package (here in his right hand) may use a finger behind the package to press on hole 22 as the blister 30 is rotated, so that the flange tab 34 as it rotates past the exit notch, is urged forward and out of the notch. Continued rotation as in FIG. 10C will then eventually "unthread" flange 32 out of the package. FIG. 10D shows how multiple exit notches 14, 14' and corresponding holes 22, 22' may be used for example to provide a package conveniently opened by either right handed or left handed customers. FIG. 10E shows another blister 30 with a flange 32 having a circular outline and a relatively simple flange tab 34 (or two flange tabs in this case). FIG. 1OF shows the assembled package using the blister/flange of FIG. 10E. Since the customer's finger pressure through rear card hole 22 pushes the flange tab 34 out of the exit notch 14, the flange tab itself need not be particularly complex, and the flange tab may be planar in some instances. The design shown in FIG. 10E is bi-directional, that is, can be opened in either direction by appropriate finger pressure through hole 22 (or flaps 22C if flaps are used). To close the package, finger pressure from the front may be used to start the flange tab 34 back into the exit notch. Several flange tabs 34 may be placed around the flange, so that finger pressure might be exerted at hole 22 several times before the package is opened.

Although certain structures are disclosed for urging or allowing the flange to 'unthread' from the package, such structures are not meant to be limiting, as other structures may also be used to urge or allow the flange to rotatably exit the package.

Although not shown here, rear card 20 may also include an aperture for receiving a blister. If such a blister is provided, it may be rotatable like the front blister for removal from or replacement into the package. Alternately it may be made stationary, for example by using a non-circular shape (so that it cannot rotate) or by sealing it to the rear card, or by trapping and/or sealing it between the front and rear cards.

The front card 10 and rear card 20 may be formed of a sheet material such as paperboard, which may be made of or coated with materials to increase its strength. An example of such a sheet material is NATRALOCK® paperboard made by MeadWestvaco Corporation. The sheet material may have a heat sealable coating, for example to allow a heat seal to be created between the rear card 20 and front card 10. Alternately, other forms of adhesive may be used to seal these cards together. It should be noted that the use of tear resistant materials, and/or in more than one layer, help to improve the tamper- and theft-resistance of the package.

The adjoining surfaces of front card 10 and rear card 20 may be adhered together by heat sealing, RF sealing, ultrasonic sealing, gluing, or other adhesive. Rear card 20 and front card 10 may, for example, be paperboard. The cards are shown with substantially the same perimeter, which may yield a package comprised of two layers of paperboard. However, portions of the package might only be single ply. One or both cards may comprise hang hole 16, or it may be reinforced with additional layer.

Heat sealing together of the front and rear cards may be accomplished by use of both heat and pressure. Heat sealing may be used just outside blister flange 32. Heat sealing may also be used along the periphery of front card 10 and rear card 20. Alternately heat sealing may be used on the entire adjoining surfaces of front card 10 and rear card 20, excepting leaving free the flange 32.

The features described in this application may be used alone or in combination with other described standing features or security features. It is to be understood that a variety of materials may be used to form these packages. However, for sustainability purposes, a paperboard based material may be used and for improved theft deterrence a tear resistant paperboard may be used. Package materials may include tear-proof materials such as DURAFOLD® paperboard, tear-resistant materials such as NATRALOCK® paperboard, as well as other types of paperboard or plastic materials. The packages may be made of one or more layers of material, including but not limited to one, two, three or more layers of material. Different parts of the packages may comprise different materials and/or different numbers of layers.

The packages disclosed herein may be comprised mostly of paperboard, for example as described in International Application PCT/US08/051245. The paperboard used in such packages may be tear-resistant as described in commonly assigned U.S. Pat. No. 7,144,635.

The packages disclosed herein may be made from one or several blanks (that is, the cut sheet parts from which the package components are made by folding and other steps). However, it should be understood that certain unitary blanks may be provided instead as more than one part, and certain blanks may be combined into single blanks, while still arriving at the same finished package.

Where more than one blank is used, the blanks may be assembled in various stages, including assembling a unitary blank into a package, assembling separate blanks and then joining them to form a package, and joining two or more blanks together, for example by heat sealing, gluing, mechanical fastening, or otherwise and then forming the combined blanks into the package.

It is to be understood that certain packages may be one continuous piece of material, and other packages may comprise two or more pieces of material. It is to be understood that a package may be heat sealed even where a heat sealed surface is in contact with a non-heat sealable surface. It is to be understood that in such a situation such an adhesion will strengthen the package, though it may not strengthen it as much as heat sealing between two heat sealable surfaces.

The packages described herein may be assembled in stages at various locations, for example partially constructing the package, moving or shipping it to one or more other locations, and completing the assembly of the package. For example, a package may be formed into a flattened or collapsible structure, then moved or shipped to another location for final forming, filling, and closure.

Portions of the packages may be made of one, two, or more layers of material. It is to be understood that additional layers of material may be used based on manufacturing preferences. Portions of certain cards may be folded over or around the portions of other cards, creating multiple layers of material.

It should be understood that additional foldover cards may be included in the package blanks for further reinforcing the packages.

Those skilled in the art will appreciate that the disclosed blister packaging structures may provide a theft deterrent function at least for a few moments, while providing legitimate consumers with packages easy to open in a reasonably short time, for example using a pair of scissors and reducing the risk of injury as the scissors are less likely to slip on the NATRALOCK® or paperboard like material than on the plastic blister pack.

To provide additional tear resistance protection, any of the materials used in these designs could be provided with overt or hidden features such as nicks, scores, perforations, holes, or other diverting features such that if a tear is initiated in the packaging material, it will not propagate in a direction more likely to breach the package, but may be rerouted by the diverting feature or features in a direction less likely to breach the package. Alternately the diverting feature may stop the tear, slow the progression of the tear, or cause it to take a meandering path, thus lengthening the time it may take to eventually breach the package, and thereby discouraging a thief. Certain tear-diverting features are described in U.S. Provisional Application No. 61/081,404.

It is to be understood that a variety of standing features or a variety of hanging features may be used on any of these package designs as determined by manufacturing preferences. One or more reinforcing layers of paperboard or other material may be placed between layers of a package, for example between the front and rear cards of a card-type package, for example at the hang hole location, as described in PCT/US08/066517. Although various aspects of the disclosed blister packaging structures have been shown and described, modifications may occur to those skilled in the art upon reading the specification.

The invention claimed is:

1. A package comprising:

a first card and a second card comprised of sheet material, the first and second cards at least partly attached together to form a two-ply structure;

a blister comprising a body portion and a flange; and an aperture in the first card to receive the blister body portion with the flange positioned between the front and rear cards;

an exit notch located on the periphery of the aperture;

wherein rotation of the blister causes the flange to emerge through the exit notch and from between the front and rear cards and allow the blister to be removed from the package.

2. The package of claim 1, the flange further comprising a flange tab which deflects into the exit notch as the blister is rotated to open the package.

3. The package of claim 2, further comprising a lifting feature formed on the flange or flange tab.

4. The package of claim 2, wherein the flange tab is flexed or bent with respect to the flange.

5. The package of claim 3, comprising a crease, score, or fold line between the flange and the flange tab whereby the flange tab is flexed or bent with respect to the flange.

6. The package of claim 2, wherein the rear card comprises a lifting feature to urge the flange tab into the exit notch.

7. The package of claim 1, further comprising an adhesive or heat seal tack point attachment between the flange and at least one of the front and rear cards, the tack point preventing rotation of the blister until sufficient torque is applied to the blister to break the tack point.

8. The package of claim 1, further comprising an adhesive or heat seal block point attachment between the front and rear cards, the block point preventing rotation of the blister until sufficient torque is applied to the blister to break the block point.

9. The package of claim 1, the flange further comprising a stop tab to prevent rotation of the flange until after the stop tab is severed from the flange.

10. The package of claim 1, further comprising a plurality of exit notches through which the flange emerges when the blister is rotated.

11. The package of claim 1, the flange further comprising a plurality of flange tabs which deflect into the exit notch as the blister is rotated to open the package.

12. The package of claim 1, further comprising a plurality of exit notches and a plurality of flange tabs, wherein the flange tabs emerges through the exit notches when the blister is rotated.

13. The package of claim 1, wherein at least one of the cards comprises a tear-resistant paper or paperboard.

14. The package of claim 1, wherein the blister comprises RPET or PLA.

15. The package of claim 1, wherein the aperture is generally circular.

16. The package of claim 1, wherein the blister is generally a circular cylinder.

17. The package of claim 1, wherein the blister fits closely within the aperture.

* * * * *